United States Patent [19]

Gardner

[11] 4,136,815

[45] Jan. 30, 1979

[54] CONVERTIBLE PARTITION ARRANGEMENT

[75] Inventor: Jeffrey M. Gardner, Wheaton, Ill.

[73] Assignee: Container Corporation of America, Chicago, Ill.

[21] Appl. No.: 883,055

[22] Filed: Mar. 3, 1978

[51] Int. Cl.[2] ..... B65D 5/48

[52] U.S. Cl. ..... 229/15; 229/42

[58] Field of Search ..... 229/15, 42, 27, 28

[56] References Cited

U.S. PATENT DOCUMENTS

| | | | |
|---|---|---|---|
| 2,919,815 | 1/1960 | Mairs et al. | 229/42 X |
| 2,925,209 | 2/1960 | Wasylura | 229/15 |
| 3,738,561 | 6/1973 | Nedenveld | 229/15 |
| 3,963,169 | 6/1976 | Gardner | 229/15 |
| 3,982,684 | 9/1976 | David | 229/15 |
| 4,030,660 | 6/1977 | Rada et al. | 229/15 |

*Primary Examiner*—Davis T. Moorhead

*Attorney, Agent, or Firm*—Carpenter & Ostis

[57] ABSTRACT

A paperboard partition arrangement which may be selectively used to form either six or eight cells within an external package.

4 Claims, 5 Drawing Figures

CONVERTIBLE PARTITION ARRANGEMENT

SUMMARY OF THE INVENTION

This invention relates to internal partitions of the type employed within outer shipping containers or other packages to provide separate internal cells.

This invention particularly relates to partitions formed of foldable sheet material, such as paperboard, which may be readily assembled for use or collapsed for shipping to the ultimate user.

It is an object of the invention to provide, in an internal partition structure, an arrangement which contains both transverse and longitudinal members interconnected in such a manner as to provide a plurality of separate cells therebetween.

A more specific object of the invention is the provision, in a partition of the type described, of a structure which lends itself to being readily converted from a six-cell arrangement to an eight-cell arrangement by the insertion of an additional partition member.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 5:
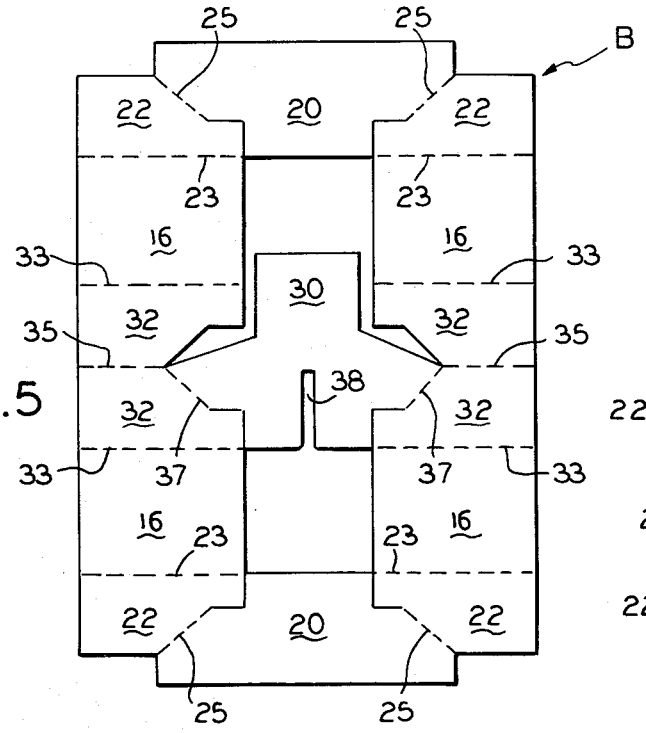
FIG. 5 is a plan view of the blank from which the structure of FIG. 1 may be formed.
Figure 2:
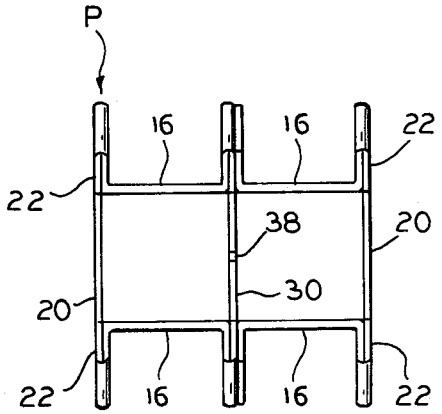
FIG. 2 is a plan view of the structure illustrated in FIG. 1.
Figure 3:
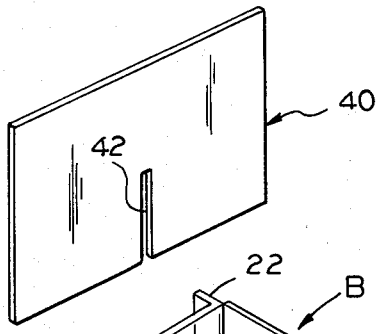
FIG. 3 is a perspective view of an additional partition member which is insertable into the structure of FIG. 1 to form additional cells.
Figure 4:
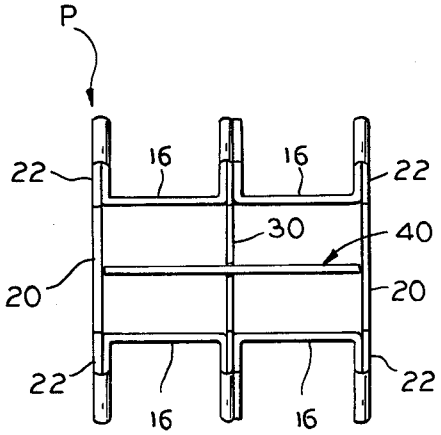
FIG. 4 is a plan view of the structure of FIG. 1 but with the additional partition member inserted.
Figure 1:
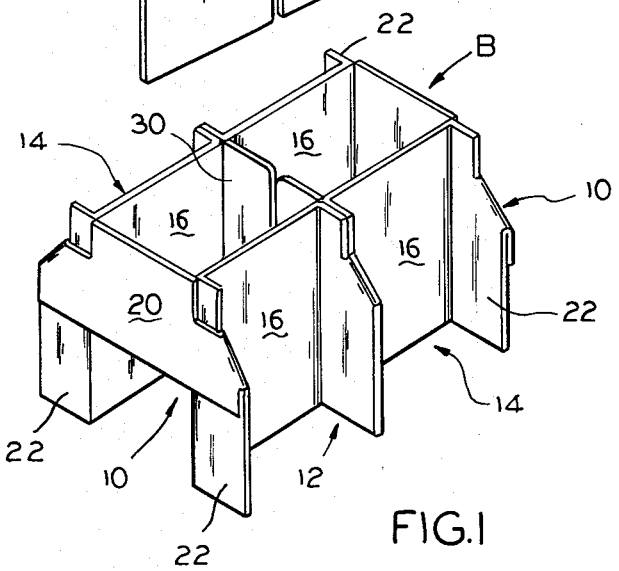
FIG. 1 is a perspective view of a partition structure embodying features of the invention.

Referring now to the drawings for a better understanding of the invention, and particularly to FIGS. 1, 2, and 5, it will be seen that a basic partition structure, indicated generally at P, may be formed from a unitary blank B of foldable paperboard, as illustrated in FIG. 5.

The basic partition structure P includes a pair of end transverse members 10 and a center transverse member 12, spaced from each other in parallel relation and interconnected by a pair of also vertically disposed longitudinal members 14 which are also spaced from each other in parallel relation and each of which includes a pair of panels 16 aligned with each other in end-to-end relation.

Each of the end transverse members 10 includes a major or outer panel 10 which is shaped somewhat in the form of an inverted T, and a pair of minor or inner panels 22 which are foldably joined at their inner edges to adjacent end edges of related longitudinal member panels 16 along vertical fold lines 23, and which are foldably joined at their outer edges to adjacent upper edges of related outer panel 20 along downwardly diverging fold lines 25.

Center transverse member 12 includes a major panel 30, which is also shaped somewhat in the form of an inverted T, and two pairs of minor panels 32.

Each pair of minor panels 32 are foldably joined at their inner edges to adjacent edges of related longitudinal member panels 16 along vertical fold lines 33, and are foldably joined at their outer edges to each other along vertical fold lines 35. Additionally, two of the minor panels 32 (one on each side of the structure) have other outer edges foldably joined to adjacent upper edges of related major panel 30 along downwardly diverging fold lines 37.

Thus, it will be seen that the basic partition structure of the invention provides a divider arrangement with six separate internal cells. This basic structure is, however, readily adaptable to be converted to an eight cell arrangement by providing a slot 38 at the upper surface of center transverse member major panel 30, adapted to mate with a slot 42 provided in a separate longitudinal partition member 40 to provide interlocking engagement therebetween.

Thus, it will be appreciated that the invention provides a unique partition arrangement which utilizes a minimum quantity of paperboard and which may be readily erected or knocked down, and which also is easily convertible from a six cell arrangement to an eight cell arrangement.

I claim:

1. In a convertible partition, formed of foldable sheet material such as paperboard, for forming a plurality of cells within an outer package, the combination of:

(a) a pair of vertical, longitudinal members spaced from each other in parallel relation and each comprising a pair of co-planar panels disposed in end-to-end relation;

(b) a pair of vertical end transverse members spaced from each other in parallel relation at opposite ends of said partition;

(c) a vertical center transverse member located intermediate and parallel to said end transverse members;

(d) each of said transverse members comprising:

(i) a major panel extending outboardly beyond said longitudinal members;

(ii) a pair of minor panels located outboardly of said longitudinal members;

(iii) said minor panels having inner edges foldably joined to adjacent side edges of related longitudinal member panels on vertical fold lines and having outer edges foldably joined to adjacent upper edges of said major panel on inclined fold lines.

2. A partition according to claim 1, wherein said center transverse member also includes a second pair of minor panels having inner edges foldably joined to adjacent side edges of other related longitudinal member panels on vertical fold lines and having outer edges foldably joined to corresponding outer edges of related first mentioned minor panels on vertical fold lines.

3. A partition according to claim 1, and including:

(a) means presented by said center transverse member for receiving an additional longitudinal member;

(b) an additional longitudinal member positioned between said pair of longitudinal members in parallel relation therewith, and having interlocking engagement with said center transverse member.

4. A partition according to claim 3, wherein said additional longitudinal member and said center transverse member have slots formed therein for mutual connection with each other.

* * * * *